US005095246A

United States Patent [19]

Feuersanger et al.

[11] Patent Number: 5,095,246

[45] Date of Patent: Mar. 10, 1992

[54] NIOBIUM-CERAMIC FEEDTHROUGH ASSEMBLY

[75] Inventors: Alfred E. Feuersanger, Framingham; William H. Rhodes, Lexington, both of Mass.

[73] Assignee: GTE Laboratories Incorporated, Waltham, Mass.

[21] Appl. No.: 620,497

[22] Filed: Nov. 30, 1990

Related U.S. Application Data

[62] Division of Ser. No. 425,072, Oct. 23, 1989, Pat. No. 5,057,048.

[51] Int. Cl.[5] ..... H01J 17/16

[52] U.S. Cl. ..... 313/623; 313/625

[58] Field of Search ..... 313/623, 624, 625

[56] References Cited

U.S. PATENT DOCUMENTS

| | | | |
|---|---|---|---|
| 3,363,144 | 1/1968 | Johnson | 313/625 X |
| 4,765,820 | 8/1988 | Naganawa et al. | 313/625 X |
| 4,827,190 | 5/1989 | Wasui et al. | 313/623 X |

*Primary Examiner*—Sandra L. O'Shea

*Attorney, Agent, or Firm*—Frances P. Craig

[57] ABSTRACT

A process for sealing of niobium-ceramic through-wall assemblies for ceramic or metal vessels for high temperature and high pressure or vacuum applications, for example an electrical feedthrough and sealable fill opening in an alumina arc tube for a high intensity discharge (HID) lamp. The process produces a fritless hermetic seal while maintaining the ductility of the niobium components. The niobium-ceramic through-wall assembly includes an axially bored alumina or yttria sealing means having a ductile niobium throughpiece close fitted to and extending through the bore. The throughpiece is preferably essentially pure niobium, but may contain up to about 2% zirconium. The assembly is fired at about 1400°-2000° C. in a pure oxygen- and hydrogen-free (<5 ppm each) inert, preferably flowing, atmosphere or vacuum for a time sufficient to form a hermetic seal between the throughpiece and the sealing means. The fired assembly is then cooled to below 250° C. while maintaining the pure inert atmosphere or vacuum. The end of the niobium throughpiece retains sufficient ductility after firing to permit pinching off of the end.

8 Claims, 3 Drawing Sheets

NIOBIUM-CERAMIC FEEDTHROUGH ASSEMBLY

This is a divisional of copending application(s) Ser. No. 07/425,072 filed on Oct. 23, 1989, now U.S. Pat. No. 5,057,048.

BACKGROUND OF THE INVENTION

This invention relates to sealing of feedthrough assemblies for ceramic or metal vessels, and in particular to niobium-ceramic feedthrough assemblies for such vessels for high temperature and high pressure or high temperature and vacuum applications, and processes for sealing same which preserve the ductile properties of the niobium.

An example of an application of the invention is the use of the feedthrough assembly according to the invention as an electrical feedthrough and sealable fill opening in ceramic lamp envelopes, for example high pressure discharge arc tubes for HID (high intensity discharge) lamps such as high pressure sodium lamps. Alumina is a preferred lamp envelope material for such lamps due to its translucence, thermal shock resistance, and corrosion resistance. Conveniently, alumina is also used to form sealing inserts hermetically sealed to and closing each end of an alumina lamp envelope tube. Alternatively, the alumina insert may seal a sapphire lamp envelope. Yttria is another possible lamp envelope and insert material, having properties similar to those of alumina.

In general, an HID lamp is constructed with a niobium feedthrough tube extending through an axial opening in each sealing insert, the niobium feedthrough being hermetically sealed to the alumina of the insert. Niobium is selected as the material for the feedthroughs because the coefficient of thermal expansion of niobium matches that of alumina over a wide range of temperatures and because the materials are chemically compatible. Tungsten electrodes extend into each end of the arc tube through the niobium feedthroughs. The electrodes are TIG (tungsten inert gas) welded to the niobium to make a hermetically sealed electrode-feedthrough assembly. The lamp is dosed with the desired lamp fill materials prior to the closing off of the second niobium feedthrough carrying the second electrode.

One type of prior art niobium-alumina seal involves the use of a ceramic sealing frit. A feedthrough assembly is first formed by welding the tungsten electrode to the niobium tube. The feedthrough assembly is then bonded to the alumina end seal using a ceramic sealing frit. One example of such a ceramic sealing frit is disclosed in U.S. Pat. No. 3,441,421, in which a composition of calcia, magnesia, and alumina is used to form a seal at a temperature of about 1400°-1500° C. However, under normal frit processing conditions, the niobium feedthroughs exhibit grain growth and recrystallization, which affect somewhat their ductility. This decrease in ductility can cause premature cracking, limiting lamp life.

Another type of seal is a brazed seal utilizing metals or eutectic metal alloys to form the braze. Such seals are described in, for example, West German Patent No. 1,013,216, in which a thin layer of metal such as Ag, Au, Cu, Ni, Fe, Co, or Mn, or alloys thereof is added to a layer of an active metal such as Ti or Zr, dissolving a portion of the active metal during the brazing process.

The processing temperatures, atmosphere, and composition of brazed seals can also result in unacceptable long term embrittlement of the niobium feedthroughs. This and the above-described ceramic frit sealing method also limit the cold spot or end temperature to 800° C. due to the softening temperature of the sealing alloys, and can introduce new phases during processing which may be reactive with certain lamp fills, for example metal halides and active metals.

Direct niobium-to-ceramic seals are disclosed in U.S. Pat. No. 4,545,799, incorporated herein by reference. The assembled inserts and lamp envelope are partially sintered, the niobium feedthroughs are inserted into the axial openings in the inserts, and the assembly is fully sintered to translucency, forming the seal as the insert material shrinks during the sintering process. This process is superior to prior processes since it permits a higher cold spot temperature than the fritted or brazed seals. A Hg lamp with a ceramic arc tube has been operated with end temperatures at 1200° C. The loss of ductility in the niobium resulting from this process may be tolerated when the niobium feedthroughs are closed off by capping. U.S. Pat. No. 4,545,799 describes a direct seal having a niobium cap welded to the feedthrough, the electrode being welded to the inside surface of the cap. It would be of great advantage, however, to further simplify the sealing process by eliminating this additional step of welding a cap to the feedthrough.

A lamp assembly having a pinched-off feedthrough, or a feedthrough which is first pinched off then welded, would greatly simplify the lamp assembly process. However, pinching-off of the feedthrough requires greater ductility in the material at the outer end of the feedthrough than does the feedthrough capping process. The present invention provides such a ductile pinched-off assembly, as well as a sealing process for achieving the required ductility at the outer end of the feedthrough.

The feedthrough assembly and sealing process according to the invention is useful for forming fritless, frit, brazed, or other seals where niobium feedthroughs are exposed to high temperatures. This improvement is due to the improved mechanical properties of the niobium. The invention is not, however, limited to use in the lamp industry, but is useful whenever a hermetic seal is desired around a niobium feedthrough, rod, wire, or other piece extending through a ceramic sealing insert or other ceramic sealing means, for example in an electrical, high pressure, or vacuum feedthrough or port assembly through the wall of a metal or ceramic vessel.

SUMMARY OF THE INVENTION

A process in accordance with the invention for fabricating a niobium-ceramic through-wall assembly for a ceramic or metal wall of a vessel involves firing at a temperature of about 1400°-2000° C. in a pure inert atmosphere or vacuum a niobium-ceramic through-wall assembly including an alumina or yttria sealing means having a bore therethrough, and a ductile niobium throughpiece close fitted to and extending through the bore. The throughpiece consists essentially of about 0-2 weight % zirconium, remainder pure niobium. The sealing means before firing is sufficiently below full density to shrink fit during firing to form a hermetic seal between the throughpiece and the sealing means. The pure inert atmosphere or vacuum includes less than about 5 ppm oxygen and less than about 5 ppm hydrogen. The firing is carried out for a time sufficient to form the hermetic seal. The assembly is cooled to below about 250° C. while maintaining the pure inert atmosphere or vacuum.

A process in accordance with another aspect of the invention for fabricating a niobium-ceramic electrical feedthrough assembly for a lamp having an alumina, yttria, or sapphire lamp envelope involves firing at a temperature of about 1400°-2000° C. in a pure inert atmosphere or vacuum a niobium-ceramic feedthrough assembly comprising an alumina or yttria end seal having a bore therethrough, and a ductile niobium tube close fitted to and extending through the bore. The niobium tube consists essentially of about 0-2 weight % zirconium, remainder pure niobium. The end seal before firing is sufficiently below full density to shrink fit during firing to form a hermetic seal between the niobium tube and the end seal. The pure inert atmosphere or vacuum includes less than about 5 ppm oxygen and less than about 5 ppm hydrogen. The firing is carried out for a time sufficient to form the hermetic seal. The assembly is cooled to below about 250° C. while maintaining the pure inert atmosphere or vacuum.

A process in accordance with yet another aspect of the invention for fabricating a lamp having an alumina, yttria, or sapphire lamp envelope involves close fitting an end seal to an open end of a lamp envelope formed from alumina, yttria, or sapphire. The end seal has an axial bore therethrough and is formed from alumina or yttria having a similar thermal expansion coefficient to that of the lamp envelope. The close fitted lamp envelope and end seal are heated at a temperature and for a time sufficient to form a first hermetic seal between the lamp envelope and end seal. A ductile niobium feedthrough tube is positioned to extend through the axial bore through the heated end seal to form a lamp envelope, end seal, and niobium tube combination. The niobium tube consists essentially of about 0-2 weight % zirconium, remainder niobium, and the axial bore is of a size to permit close fitting of the niobium tube therethrough. The lamp envelope, end seal, and niobium tube combination is fired at a temperature of about 1400°-2000° C. in a pure inert atmosphere or vacuum. The end seal after heating and before firing is sufficiently below full density to shrink fit during firing to form a second hermetic seal between the end seal and the niobium tube. The pure inert atmosphere or vacuum includes less than about 5 ppm oxygen and less than about 5 ppm hydrogen. The firing is carried out for a time sufficient to form the second hermetic seal. The fired lamp envelope, end seal, and niobium tube combination is cooled to below about 250° C. while maintaining the pure inert atmosphere or vacuum.

A niobium-ceramic through-wall assembly according to still another aspect of the invention for a ceramic or metal wall of a vessel includes a fully dense alumina or yttria sealing means having a bore therethrough, and a niobium throughpiece extending through the bore and hermetically sealed therein without frit or braze. The niobium throughpiece consists essentially of about 0-2 weight % zirconium, remainder pure niobium, and retains sufficient ductility at at least one end to permit cold welding by pinching off of the at least one end.

A niobium-ceramic electrical feedthrough assembly according to yet another aspect of the invention for a lamp having an alumina, yttria, or sapphire lamp envelope includes an alumina or yttria end seal having a bore therethrough, and a niobium tube extending through the bore and hermetically sealed therein without frit or braze. The niobium tube consists essentially of about 0-2 weight % zirconium, remainder pure niobium, and retains sufficient ductility at at least one end to permit cold welding by pinching off of the at least one end.

A lamp according to still another aspect of the invention includes a lamp envelope formed from fully dense, translucent alumina, yttria, or sapphire and having at least one end, an end seal hermetically sealing the end of the lamp envelope without frit or braze, the end seal having a bore therethrough and being formed from fully sintered alumina or yttria having a similar thermal expansion coefficient to that of the lamp envelope. and a niobium feedthrough tube extending through the bore and hermetically sealed therein without frit or braze. The niobium tube consists essentially of about 0-2 weight % zirconium, remainder niobium, and has an end internal to the lamp envelope and an end external to the lamp envelope. The niobium tube retains sufficient ductility at the external end to permit cold welding by pinching off of the external end.

BRIEF DESCRIPTION OF THE DRAWINGS

For a better understanding of the present invention, together with other objects, advantages and capabilities thereof, reference is made to the following Description and appended claims, together with the Drawings, in which:

DETAILED DESCRIPTION OF THE PREFERRED EMBODIMENTS

Identification of Possible Embrittling Factors

Early attempts to fabricate fritless niobium feedthroughs with alumina envelopes resulted in high quality hermetic seals between the alumina end sealing means and the niobium tube. The seals were fired in a Centorr furnace, Model M60, previously used to sinter alumina at high temperatures. Pliers were utilized to pinch off the feedthrough in an attempt to form a cold weld between the walls of the tubing. However, the niobium was inadvertently embrittled to such a degree that such attempts to deform the fired feedthrough sufficiently to form the pinch-off seal at the tip resulted in catastrophic failure of the niobium feedthrough tube, i.e. the tip was shattered into fragments. The niobium tubes fired in these early attempts were no longer sufficiently ductile to withstand the plastic deformation involved in the pinching-off process. Thus, the feedthroughs in known direct seals are closed off by capping the tip of the feedthrough, as described above.

Figure 2:
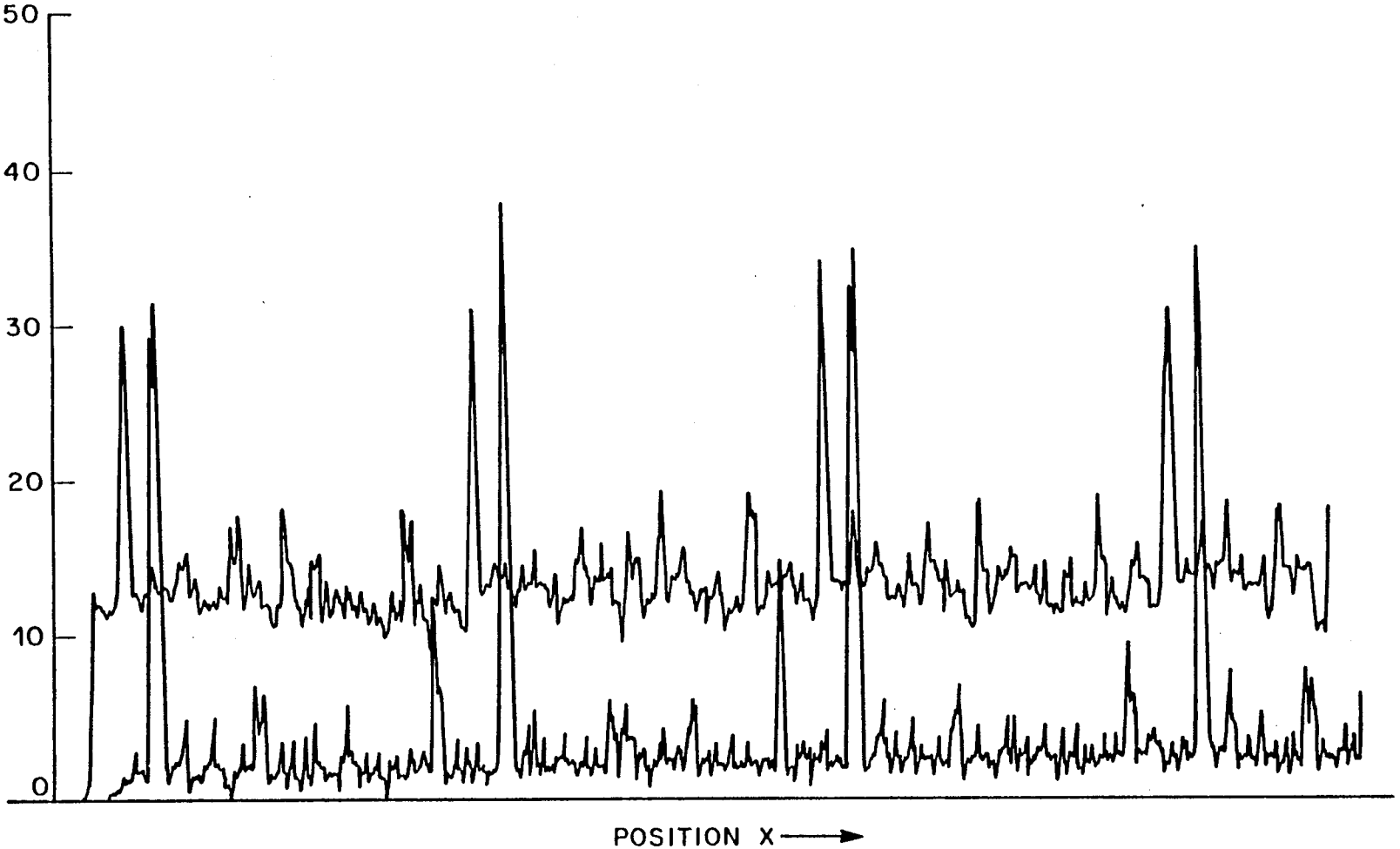
FIG. 2 is an electron microprobe analysis of an undesirable sample, not processed in accordance with the invention, illustrating in simultaneous scans the presence of embrittling impurities in the niobium.

In an attempt to determine the cause of the embrittlement, an electron microprobe analysis was performed on one Nb-1%Zr sample fired at 1880° C. in the above-described Model M60 furnace in an argon atmosphere for 120 min. The electron microprobe scan, FIG. 2, shows that as oxygen (upper trace) is detected in a traverse of three grains (axis X), the peaks occurring at somewhat regular intervals apparently indicating grain boundaries, there is a coincidence of zirconium peaks (lower trace, offset) with the oxygen peaks, indicating apparent formation of zirconium oxide at the grain boundaries, leading to precipitation hardening. In niobium samples containing no zirconium, the hardening appears to be caused by interstitial solid solution hardening as impurity gases combine in the grain boundaries with trace impurities within the niobium.

A mass spectrometric gas analysis was performed on the gases used to fire, at 1880° C., the above-described fritless seals in the Centorr furnace, Model M60. The results of the analysis are depicted below in the center column of Table I. It may be seen that certain impurity gases present in the atmosphere used in the Model M60 furnace apparently contributed to the embrittlement of the niobium, with hydrogen and oxygen being the likely major embrittling agents.

TABLE I

| Gas Component | Model M60, content, ppm | Model 15, content, ppm |
|---|---|---|
| Ar | Major | Major |
| $H_2$ | 140-150 | Not detected |
| CO | 60-65 | 65-70 |
| $N_2$ | 30-35 | 5-10 |
| $CO_2$ | 25-30 | 15-20 |
| $O_2$ | 5-10 | Not detected |

Confirmation of Embrittling Factors

Other samples of fritted and fritless seals between ceramics and niobium were fired in a purer atmosphere at 1860° C. for 120 min. The furnace used was a Centorr furnace, Model 15, previously used to sinter only pure metal alloys in oxygen- and hydrogen-free, inert atmospheres. Thus the atmosphere when firing the seal samples was not contaminated by the desorption of hydrogen and oxygen impurity gases from the refractory metal furnace fixtures, heater, and heat shields. The mass spectrographic gas analysis of the atmosphere used in firing these samples in the Model 15 furnace is shown in the right hand column of Table I. It may be seen from Table I that hydrogen and oxygen in this case are below the detectable limit.

In these samples, the niobium feedthrough tubes were still sufficiently ductile after firing to be readily deformed into pinch-off hermetic seals without cracking of the tubing. Since the CO, $N_2$, and $CO_2$ levels in the two furnaces were both significant (Table I), hydrogen and oxygen are identified as the major contributors to the embrittlement of the niobium tubing during firing.

Analysis of Hardness of Various Nb Tubing Samples

Microhardness measurements performed on different types of samples, compiled in Table II, confirm the foregoing conclusions regarding the cause of the embrittlement. The Knoop hardness under a 100 gm load was determined for a control sample, the niobium feedthrough tube of a 150 W high pressure sodium (HPS) electrode assembly from a GTE Products Corporation production line. The hardness was also determined for the niobium tubing as received (before firing), and for the tubing after firing in the Model M60 and Model 15 furnaces with respective atmospheres as described above in Table I. In all of these samples, the Zr content of the niobium was 1% by weight. It may be seen in Table II that the hardness of the samples fired by the process according to the invention were significantly lower than those of both the prior art fritless seal and the prior art frit seal from the production line, and were only slightly raised from that of the tubing as received.

TABLE II

| SAMPLE | HARDNESS $Kg/mm^2$ |
|---|---|
| Production HPS electrode assembly | 156.3 |
| Annealed ductile Nb Tubing, as received | 120.4 |
| Nb tubing after sealing in Model M60 furnace, $O_2$ & $H_2$ in atmosphere | 375.5 |
| Nb tubing after sealing in Model 15 furnace, $O_2$ & $H_2$ free atmosphere, first run | 116.5 |
| Nb tubing after sealing in Model 15 furnace, $O_2$ & $H_2$ free atmosphere, second run | 132.8 |

The Process, Assembly, and Lamp According to the Invention

Figure 1:
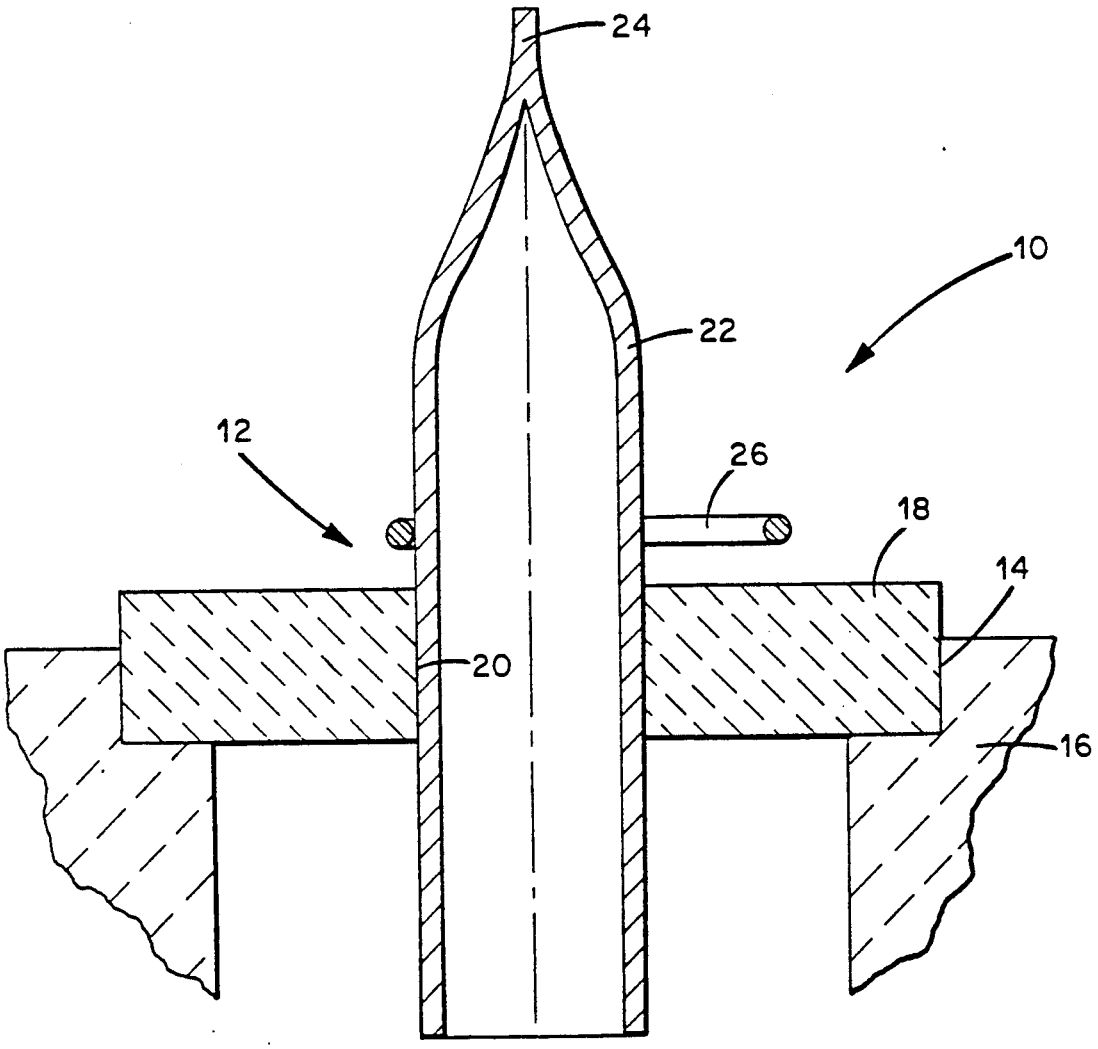
FIG. 1 is a schematic view in partial cross-section of a niobium electrical feedthrough and an end seal fired in seal fabrication with an alumina envelope, with the tip of the feedthrough being pinched off, in accordance with one embodiment of the invention (the electrode, normally welded into the feedthrough, is not shown)

One embodiment of a through-wall assembly according to the invention is illustrated in FIG. 1, in which HID lamp 10 includes electrical feedthrough assembly 12 inserted into and sealing end 14 of alumina lamp envelope 16. Feedthrough assembly 12 includes alumina end seal or sealing insert 18 having axial bore 20 therethrough. Niobium feedthrough tube 22 of ductile, high purity niobium is close-fitted into axial bore 20 and forms a fritless hermetic seal therewith. A tungsten electrode (not shown) is welded to niobium tube 22, and extends into the end of lamp envelope 16 from the tube. Tip 24 of niobium tube 22 is cold welded by pinching-off to complete the hermetic sealing of lamp 10. In other embodiments, the feedthrough may be a high purity niobium rod or wire. Alternatively, the lamp envelope may be sapphire sealed with an alumina insert, or an yttria envelope may be sealed with an yttria insert. The terms "alumina" and "yttria" are not restricted to mean only the pure compounds, but may include other alumina- or yttria-based materials suitable for lamp fabrication, for example, mixtures of alumina and yttria. Other end sealing means may be substituted for insert 18, for example an alumina cap may be fitted over end 14. The opposite end (not shown) of lamp 10 may be similarly configured to end 14, or may comprise a conventional or other lamp seal. Alternatively, the lamp envelope may have only one end opening, the end seal being provided with two (or more) bores to receive two feedthroughs and electrodes, preferably positioned symmetrically relative to the axis of the end seal.

The process in accordance with the invention is designed to prevent the niobium of feedthrough tube 22 from becoming embrittled, and utilizes high purity materials and a high purity firing atmosphere. The niobium portion is fabricated from well annealed, ductile, high purity niobium or high niobium alloy. Preferably, the niobium contains 0–2 weight % zirconium, e.g. Nb-1%Zr, a high purity niobium alloyed with about 1% zirconium.

It is preferred that the elements of the cleaned furnace, e.g. tungsten ribbon (mesh) heating elements and molybdenum heat shields, be further cleaned before firing the throughwall assembly by performing a high temperature cleanup run. The cleanup run can involve outgassing and rinsing with a pure inert atmosphere to remove oxide, etc. contaminants, at about 100° C. above the firing temperature. Care is exercised in keeping the furnace evacuated or filled with the pure inert atmosphere between the cleaning and firing operations to insure lowest possible levels of $O_2$ and $H_2$ on subsequent heating. Also, the furnace is cooled, preferably to room temperature, before the furnace interior is exposed to the ambient atmosphere for unloading, to minimize oxidation of the furnace elements.

The high purity niobium feedthrough tubing is prepared for sealing by welding an electrode (for a high intensity discharge (HID) lamp) or other electrical connection to one end, for example by TIG welding. A refractory metal wire, for example of tantalum, molybdenum, or preferably niobium, is spot welded to the feedthrough, as indicated by the reference numeral 26 in FIG. 1, to hold the feedthrough in position during the sealing cycle. The feedthrough is then positioned within an axial bore through a green, or only partially sintered, alumina sealing insert, the bore being sufficiently close fitting that the insert will shrink-fit on final sintering to form a fritless hermetic seal with the feedthrough.

The feedthrough/insert assembly is placed in a clean high temperature, high vacuum/gas atmosphere sintering furnace. The furnace is then evacuated to $<1$ mTorr ($<0.133$ Pa), well flushed with an ultrapure inert atmosphere at atmospheric pressure, and again evacuated to $<1$ mTorr ($<0.1333$ Pa). To avoid contamination by any residual contaminants which may be present, the feedthrough assembly is heated to the required sealing temperature in a vacuum of, for example, $<1\times10^{-6}$ Torr ($<133.3\times10^{-6}$ Pa) or, preferably, in an ultrapure inert atmosphere, e.g. argon, most preferably a flowing ultrapure inert atmosphere. Commercially available inert gases from tanks have not been found to be sufficiently pure for use in the process according to the invention. For example, commercial argon typically includes about 3 ppm (parts per million) $H_2O$ and traces of other oxidizing components, nitrogen, and hydrocarbons.

It is critical in order to practice the process according to the invention to maintain an ultrapure high vacuum atmosphere or an ultrapure inert gas atmosphere within the furnace, i.e. a vacuum or inert atmosphere containing less than about 5 ppm oxidizing components, and less than about 5 ppm hydrogen. This has been achieved in practice for the inert atmosphere through the use of an in-line Centorr gettering furnace Model 2B-20-Q, to further purify the inert gas supplied to the sintering furnace. The gettering furnace is supplied with cryogenic argon from a purified, in-house supply. The in-house supply contains about 5–10 ppm oxygen, purer than is normally commercially available, but further purification is required to achieve the desired low levels of oxygen and hydrogen. The atmosphere supplied by the gettering furnace contains $<10^{-6}$ ppm $O_2$ and $<10^{-6}$ ppm $H_2$.

It is preferred that a low level of inert gas flow, most preferably about 4 liters/min, be maintained in the sintering furnace. A 4 liters/min flow replaces the argon atmosphere in the Model 15 furnace every 40 sec, preventing any contaminants desorbed from the furnace elements at high sealing temperatures from contaminating the niobium of the feedthrough assembly.

The assembly is heated to a maximum temperature of about 1500°–2000° C., preferably 1840°–1860° C., to form a hermetic seal between the alumina and the niobium tube. The assembly is cooled to below about 250° C., preferably below about 100° C., before removal from the sintering furnace. The pure, inert, preferably flowing, atmosphere or the pure high vacuum atmosphere is maintained during the cooling cycle to avoid oxidation of the assembly by exposure of the hot assembly to the ambient atmosphere.

Figure 3:
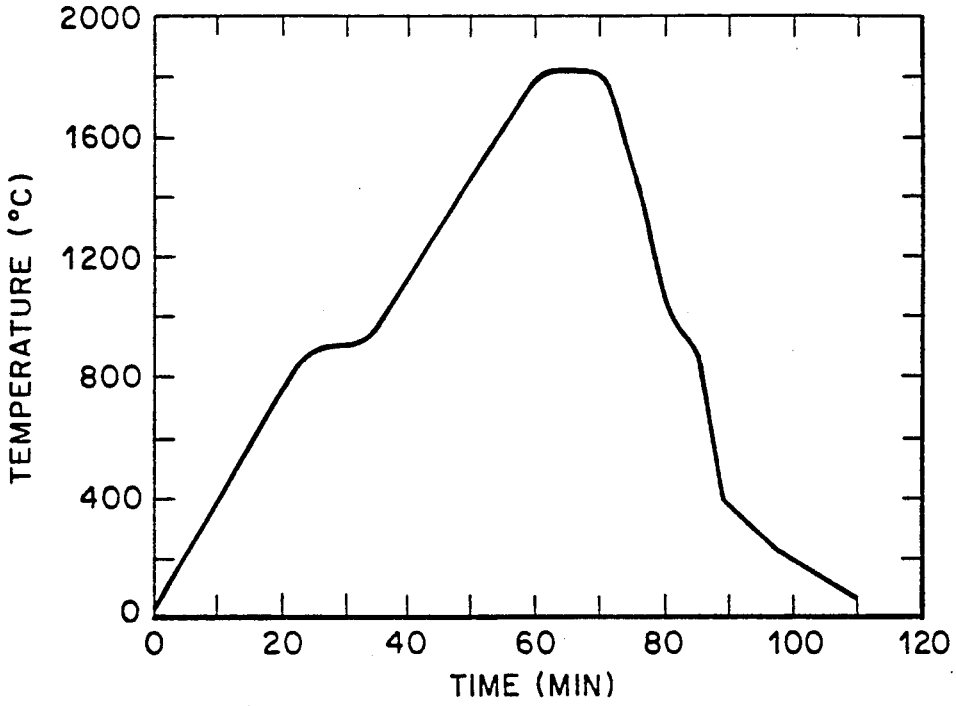
FIG. 3 is a graphical representation of a typical temperature cycle of one embodiment of the process in accordance with the invention.
Figure 4:
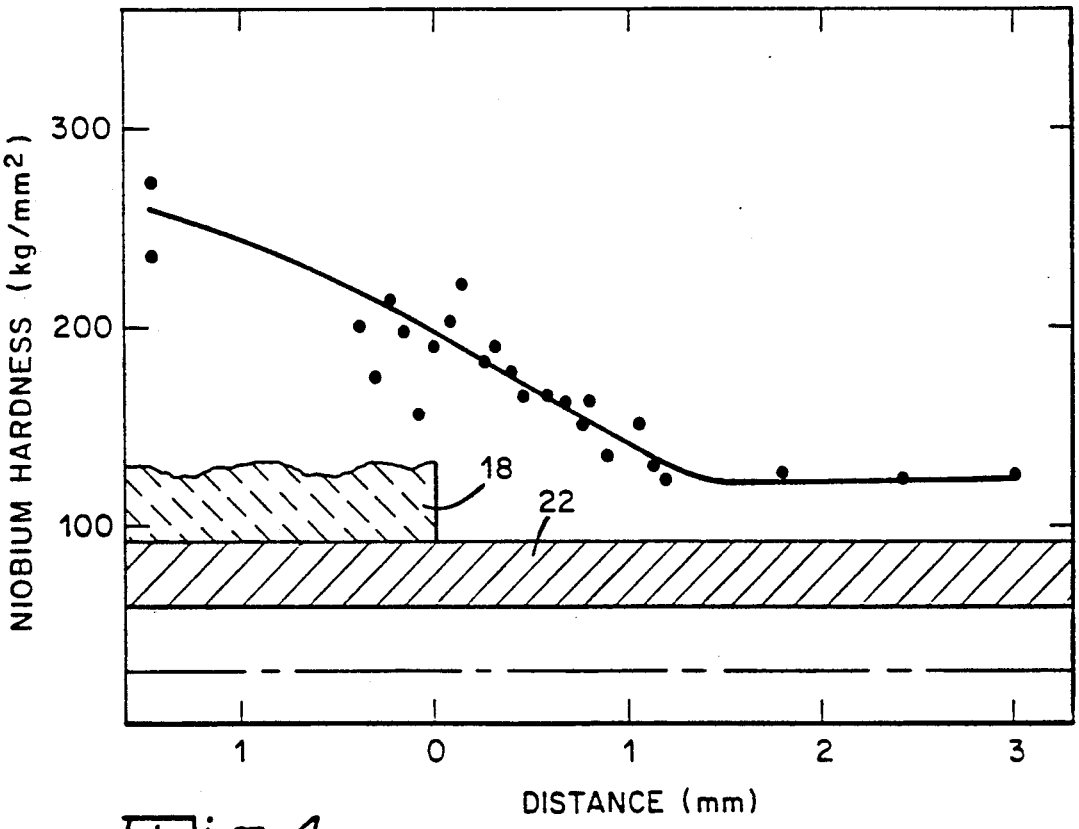
FIG. 4 is a schematic representation of a feedthrough assembly in accordance with one embodiment of the invention superimposed on a graphical representation of the change in hardness of the niobium feedthrough tube of the assembly with distance from the alumina insert.

A typical heating cycle is illustrated in FIG. 3, showing heating to a maximum temperature of about 1840° C. at a rate of about 35° C./min, with a brief hold at about 900° C., and a cooling rate of about 75° C./min. On cooling, it is found that only the niobium in intimate contact with the alumina, i.e. in the vicinity of bore 20, shows a degree of hardness, while the free end or tip remains sufficiently ductile for later deformation. This effect is illustrated schematically in FIG. 4, in which a schematic representation of the feedthrough assembly is superimposed on a plot of the hardness at various distances from the insert/tubing interface. Typically, the feedthrough is pinched off at about 7 mm from the sealing insert.

When the sealing is carried out during a lamp fabrication process, the final firing process may be used to achieve both sealing of the niobium ceramic interface and sintering of the lamp envelope to translucency if, for example, the firing is carried out in the above-described high vacuum.

The following Examples are presented to enable those skilled in the art to more clearly understand and practice the present invention. The Examples should not be considered as a limitation upon the scope of the present invention, but merely as being illustrative and representative thereof.

EXAMPLE 1

The Centorr furnace, Model 15, was outgassed by evacuating to $<1$ mTorr. The furnace was then heated to about 1930° C. for 15 min and cooled to room temperature, both while rinsing with the ultra-purified argon supplied by an in-line gettering furnace, as described above.

Two generally cylindrical caps of green alumina were prepared, of a size to permit upon sintering to full density shrinking of the cap onto one end of a fully sintered, translucent 0.288 inch outer diameter (150 W, 55 V size) alumina arc tube to form a hermetic seal.

Each cap included an axial bore of a size to shrink fit upon sintering to full density onto a 0.125 inch diameter Nb-1% Zr feedthrough tube. A tungsten lamp electrode had been previously TIG welded to one end of a first feedthrough, effectively closing that end. The second feedthrough was similarly provided with an electrode by TIG welding; however, an orifice was provided through the second feedthrough end near the electrode.

The arc tube, one cap, and first feedthrough were assembled with the cap covering one open end of the arc tube, and the feedthrough extending through the bore with the electroded end extending into the arc tube. This assembly was placed in the Model 15 furnace, which was then evacuated, back-filled with ultrapure argon from the above-described in-line gettering furnace, and heated, in the ultrapure argon atmosphere flowing at about 4 liters/min, according to the heating schedule shown in FIG. 3.

Hermetic seals were formed during sintering between the cap and the arc tube and between the cap and the niobium feedthrough. These hermetic seals cooperated with the welded end of the first feedthrough to effectively seal the first end of the arc tube.

The assembly and sintering process was then repeated for the second end of the arc tube. However, before sealing off the open end of the second feedthrough tube, the lamp was dosed with solid lamp fills and a gaseous buffer gas. The arc tube was placed in a dry box and dosed with the solid lamp fill ingredients, 30 mg of a sodium-mercury amalgam having a Hg:Na weight % ratio of 75:25, through the open outer end of the second feedthrough tube and through the orifice near the tungsten electrode at the inner end. The xenon buffer gas fill was introduced, also through the feedthrough and orifice, to a fill pressure of 20 Torr in known manner. The arc tube was then sealed by pinching off the outer end of the second feedthrough tube with pinching pliers to form a cold Weld.

The second niobium feedthrough tube was found to be sufficiently ductile after sintering to permit formation of the required hermetic cold weld by pinching off of the tube.

A first disc-shaped, green alumina sealing insert including an axial bore, sized as described below, is inserted in a close fitting relationship, as described in U.S. Pat. No. 4,545,799, into a first end of a standard cylindrical, 0.375 inch outside diameter (400 W, 100 V size), green alumina high pressure discharge arc tube. The arc tube/insert combination is partially sintered by heating in an atmospheric furnace, as described in U.S. Pat. No. 4,545,799. During the sintering, the diameter of the arc tube shrinks more than that of the insert, creating a hermetic bond at the arc tube/insert interface.

The axial bore through the first sealing insert is sized, as described in U.S. Pat. No. 4,545,799, to allow close fitting therethrough after the partial sintering step of the first of two niobium-1% Zr feedthrough tubes, each 0.158 inch outside diameter by 1.25 inches long. A tungsten electrode is TIG welded into each of the feedthrough tubes in known manner, the first feedthrough tube being welded closed, the other, second feedthrough tube including an orifice through the welded end, as described above for Example 1. The first, closed, feedthrough tube is inserted without brazing or frit into the axial bore of the first insert to form a first feedthrough assembly at the first end of the arc tube. The feedthrough tube is temporarily held in place by spot-welded niobium wires.

The arc tube and first feedthrough assembly combination is fully sintered in the Centorr furnace, Model M60, at about 1840° C. until the arc tube achieves translucency, about 2 hr, in the in-house supplied argon atmosphere described in Table I, center column, and is cooled to room temperature in the same flowing argon. A hermetic seal is formed between the first alumina insert and the associated feedthrough tube during the process of sintering the arc tube to translucency.

The Centorr furnace, Model 15, is outgassed by evacuating to <1 mTorr. The furnace is then heated to about 1930° C. for 5 min and cooled to room temperature, both while rinsing with the ultra-purified argon supplied by an in-line gettering furnace, as described above.

A generally cylindrical cap of green alumina, as described above for Example 1, is prepared, of a size to permit upon sintering to full density shrinking of the cap onto the second, open end of the fully sintered, translucent alumina arc tube to form a hermetic seal. Also as described above for Example 1, the cap includes an axial bore of a size to shrink fit upon sintering to full density onto the second feedthrough tube, which has an orifice through end near the electrode.

The arc tube, cap, and second feedthrough are assembled with the cap covering the open end of the arc tube, and the feedthrough extending through the bore with the electroded end extending into the arc tube. This assembly is placed in the Model 15 furnace, which is then evacuated, back-filled with ultrapure argon from the above-described in-line gettering furnace, and heated and cooled according to the schedule shown in FIG. 3 in the ultrapure argon atmosphere flowing at about 4 liters/min.

Hermetic seals are formed during sintering between the cap and the arc tube and between the cap and the second niobium feedthrough. The ultrapure atmosphere contains $<10^{-6}$ ppm oxygen and $<10^{-6}$ ppm hydrogen; thus the ductility of the second, open feedthrough tube is only minimally affected during sintering.

One end of the arc tube is hermetically sealed at the the welded closed first feedthrough tube, while the second tube provides access to the arc tube interior through the open outer end and the orifice near the welded electrode. The arc tube is then dosed as described in Example 1 with solid and gaseous fill materials through the orifice in the second feedthrough tube. The outer end of the feedthrough tube is hermetically sealed by pinching off to form a cold weld, completing the sealing of the arc tube.

EXAMPLE 3

A disc-shaped, green alumina sealing insert including an axial bore, sized as described below, is inserted in a close fitting relationship into each end of a standard cylindrical, 0.375 inch outside diameter (400 W, 100 V size), green alumina high pressure discharge arc tube. The arc tube/insert combination is partially sintered by heating in an atmospheric furnace, as described in U.S. Pat. No. 4,545,799. During the sintering, the diameter of the arc tube shrinks more than that of the insert, creating a hermetic bond at the arc tube/insert interface.

The axial bores through the sealing inserts are sized to allow close fitting therethrough, after the partial sintering step, of niobium-1% Zr feedthrough tubes, 0.158 inch outside diameter by 1.25 inches long. A tungsten electrode is TIG welded into each of two feedthrough tubes in known manner, a first tube being welded closed, the other, second tube including an orifice through the welded end, as described above for Example 1. Each niobium tube is inserted without brazing or frit into one of the axial bores to form a feedthrough assembly at each end of the arc tube. The feedthroughs are temporarily held in place by spot-welded niobium wires.

The Centorr furnace, Model 15, is outgassed by evacuating to <1 mTorr. The furnace is then heated to about 1930° C. for 5 min and cooled to room temperature, both while rinsing with the ultra-purified argon supplied by an in-line gettering furnace, as described above.

The arc tube and feedthrough assembly combination is placed in the Model 15 furnace, which is then evacuated to <1 mTorr, rinsed with the ultrapure argon, and evacuated again to $<10^{-6}$ Torr. The arc tube and feedthrough assembly combination is then fully sintered at about 1840° C. until the arc tube achieves translucency, about 2 hr, while maintaining the vacuum level, and is cooled to room temperature at the same vacuum level.

A hermetic seal is formed between each alumina insert and the associated feedthrough tube during the sintering to translucency of the arc tube. The vacuum atmosphere in the furnace contains $<10^{-6}$ ppm oxygen and $<10^{-6}$ ppm hydrogen; thus the ductility of the second, open feedthrough tube is only minimally affected during sintering.

One end of the arc tube is hermetically sealed at the welded closed first feedthrough tube, while the second tube provides access to the arc tube interior through the open outer end and the orifice near the welded electrode. The arc tube is then dosed as described in Example 1 with solid and gaseous fill materials through the orifice in the second feedthrough tube. The outer end of the feedthrough tube is hermetically sealed by pinching off to form a cold weld, completing the sealing of the arc tube.

The process according to the present invention permits sealing of a niobium-ceramic through-wall assembly for a ceramic or metal wall of a vessel, at temperatures significantly above those used for achieving frit seals (typically about 1460° C.), with minimal embrittlement of the niobium portion. One example of such an assembly is an electrical feedthrough assembly for a lamp having an alumina envelope. Thus, the niobium retains a sufficient degree of ductility after firing to allow pinching-off or other deformation, and the formation of a cold weld hermetic seal. The novel process also permits the combination of direct, fritless sealing with pinching off of the niobium feedthrough tube to achieve a particularly efficient seal fabrication process and a lamp having a higher cold spot temperature limit. When a vacuum including <5 ppm each of oxygen and hydrogen is used as the firing atmosphere, an optimally efficient process is achieved, combining sintering to translucency and fritless seal fabrication in a single sintering step while permitting final sealing of the arc tube by pinching off of the niobium feedthrough tube.

While there has been shown and described what are at present considered the preferred embodiments of the invention, it will be obvious to those skilled in the art that various changes and modifications can be made therein without departing from the scope of the invention as defined by the appended claims.

We claim:

1. A niobium-eramic through-wall assembly for a ceramic or metal wall of a vessel, comprising:

a fully dense alumina or yttria sealing means having a bore therethrough; and a niobium throughpiece extending through said bore sealed therein, and consisting essentially of about 0–2 weight % zirconium, remainder pure niobium;

wherein the seal between said niobium throughpiece and said bore is a fritless, brazeless hermetic seal and said niobium throughpiece retains sufficient ductility at at least one end to permit cold welding by pinching off of said at least one end.

2. An assembly in accordance with claim 1 wherein the assembly was fabricated by a process comprising the steps of:

firing at a temperature of about 1400°–2000° C. in a pure inert atmosphere or vacuum a niobium-ceramic throughwall assembly comprising an alumina or yttria sealing means having a bore therethrough, and a ductile niobium throughpiece close fitted to and extending through the bore;

wherein the throughpiece consists essentially of about 0–2 weight % zirconium, remainder pure niobium; the sealing means before firing is sufficiently below full density to shrink fit during firing to form a hermetic seal between the throughpiece and the sealing means; the pure inert atmosphere or vacuum includes less than about 5 ppm oxygen and less than about 5 ppm hydrogen; and the firing is carried out for a time sufficient to form the hermetic seal; and cooling the assembly to below about 250° C. while maintaining the pure inert atmosphere or vacuum.

3. A niobium-ceramic electrical feedthrough assembly for a lamp having an alumina, yttria, or sapphire lamp envelope, comprising:

an alumina or yttria end seal having a bore therethrough; and a niobium tube extending through said bore and sealed therein, and consisting essentially of about 0–2 weight % zirconium, remainder pure niobium;

wherein the seal between said niobium tube and said bore is a fritless, brazeless hermetic seal and said niobium tube retains sufficient ductility at at least one end to permit cold welding by pinching off of said at least one end.

4. An assembly in accordance with claim 3 wherein the assembly was fabricated by a process comprising the steps of:

firing at a temperature of about 14500°–2000° C. in a pure inert atmosphere or vacuum a niobium-ceramic feedthrough assembly comprising an alumina or yttria end seal having a bore therethrough, and a ductile niobium tube close fitted to and extending through the bore;

wherein the niobium tube consists essentially of about 0–2 weight % zirconium, remainder pure niobium; the end seal before firing is sufficiently below full density to shrink fit during firing to form a hermetic seal between the niobium tube and the end seal; the pure inert atmosphere or vacuum includes less than about 5 ppm oxygen and less than about 5 ppm hydrogen; and the firing is carried out for a time sufficient to form the hermetic seal; and cooling the assembly to below about 250° C. while maintaining the pure inert atmosphere or vacuum.

5. A lamp comprising:

a lamp envelope formed from fully dense, translucent alumina, yttria, or sapphire and having at least one end;

an end seal hermetically sealing the end of said lamp envelope without frit or braze, said end seal having a bore therethrough and being formed from fully sintered alumina or yttria having a similar thermal expansion coefficient to that of said lamp envelope; and a niobium feedthrough tube extending through said bore and sealed therein, and consisting essentially of about 0–2 weight % zirconium, remainder niobium, and having an end internal to said lamp envelope and an end external to said lamp envelope;

wherein the seal between said niobium tube and said bore is a fritless, brazeless hermetic seal and said niobium tube retains sufficient ductility at said external end to permit cold welding by pinching off of said external end.

6. A lamp in accordance with claim 5 wherein the lamp was fabricated by a process comprising the steps of:

close fitting an end seal to an open end of a lamp envelope formed from alumina, yttria, or sapphire; wherein the end seal has an axial bore therethrough and is formed from alumina or yttria having a similar thermal expansion coefficient to that of the lamp envelope;

heating the close fitted lamp envelope and end seal at a temperature and for a time sufficient to form a first hermetic seal between the lamp envelope and end seal;

positioning a ductile niobium feedthrough tube to extend through the axial bore through the heated end seal to form a lamp envelope, end seal, and niobium tube combination; wherein the niobium tube consists essentially of about 0-2 weight % zirconium, remainder niobium; and the axial bore is of a size to permit close fitting of the niobium tube therethrough;

firing at a temperature of about 1400°-2000° C. in a pure inert atmosphere or vacuum the lamp envelope, end seal, and niobium tube combination; wherein the end seal after heating and before firing is sufficiently below full density to shrink fit during firing to form a second hermetic seal between the end seal and the niobium tube; the pure inert atmosphere or vacuum includes less than about 5 ppm oxygen and less than about 5 ppm hydrogen; and the firing is carried out for a time sufficient to form the second hermeti seal; and cooling the fired lamp envelope, end seal, and niobium tube combination to below about 250° C. while maintaining the pure inert atmosphere or vacuum.

7. A lamp in accordance with claim 5 further comprising a hermetic cold weld at the external end of the niobium tube.

8. A lamp in accordance with cliam 6 wherein:

the close fitting step comprises close fitting a green end seal to an open end of a lamp envelope formed from green alumina or yttria; and the heating step is carried out for a time sufficient to partially sinter the end seal and lamp envelope and to form the first hermetic seal between the lamp envelope and end seal;

the firing step is carried out in a vacuum including less than about 5 ppm oxygen and less than about 5 ppm hydrogen and for a time sufficient to achieve translucency in the lamp envelope, to fully sinter the end seal, and to form the second hermetic seal.

* * * * *